US005249408A

United States Patent [19]

Winnemöller et al.

[11] Patent Number: 5,249,408

[45] Date of Patent: Oct. 5, 1993

[54] PROCESS OF AND APPARATUS FOR PACKAGING A STACK OF FLAT OBJECTS

[75] Inventors: Aloys Winnemöller, Rheine; Heinrich Frommeyer, Hagen a.T.W.; Werner Wieneke, Lengerich, all of Fed. Rep. of Germany

[73] Assignee: Windmöller & Hölscher, Lengerich/Westf., Fed. Rep. of Germany

[21] Appl. No.: 832,592

[22] Filed: Feb. 7, 1992

[30] Foreign Application Priority Data

Feb. 7, 1991 [DE] Fed. Rep. of Germany ..... 4103745

[51] Int. Cl.[5] ..... B65B 11/12; B65B 27/08; B65B 63/02

[52] U.S. Cl. ..... 53/439; 53/228; 53/371.8; 53/528

[58] Field of Search ..... 53/439, 528, 229, 228, 53/371.8, 371.9, 372.2; 493/259, 252, 936

[56] References Cited

U.S. PATENT DOCUMENTS

| | | | |
|---|---|---|---|
| 1,285,646 | 11/1918 | Drake et al. | 53/371.8 X |
| 1,575,723 | 3/1926 | Smith et al. | 53/371.8 X |
| 3,507,089 | 4/1970 | Mizzeile et al. . | |
| 3,619,976 | 11/1971 | Kerker | 53/528 |
| 3,771,280 | 11/1973 | Bechle | 53/32 |
| 3,938,304 | 2/1976 | Utsumi | 53/229 |

FOREIGN PATENT DOCUMENTS

| | | |
|---|---|---|
| 244356 | 3/1912 | Fed. Rep. of Germany . |
| 951268 | 3/1964 | United Kingdom . |

*Primary Examiner*—James F. Coan
*Attorney, Agent, or Firm*—Keck, Mahin & Cate

[57] ABSTRACT

To package a stack of flat objects, such as bags provided with handles, the stack having a height exceeding widths of the objects, the stack is wrapped by a section of a web of paper or plastic. The marginal portions of the web section which overlap at one side face of the stack are adhesively bonded to each other to form a tubular wrapper around the stack. End portions of the wrapper, which protrude from the ends of the stack, are folded onto the end faces of the stack so as to form folded corner portions. The folded corner portions are folded onto and adhesively bonded to one side face of the stack. To permit simple packaging, one side portion of each protruding end portion of the tubular wrapper is first folded onto the adjacent open end face of the stack about the longer edge of the end face. The adjacent ends of each protruding end portion of the wrapper are pulled out and flattened into the plane of the folded inside portion so that the opposite side portion of the protruding end portion is folded about an opposite longer edge of the adjacent end face of the stack onto the end face. Folded corner portions, protruding from the stack, are thus formed. The folded corner portions are then folded onto and adhesively bonded to the wrapper on those side faces of the stack which adjoin the initially open side face of the stack.

3 Claims, 4 Drawing Sheets

Fig.1
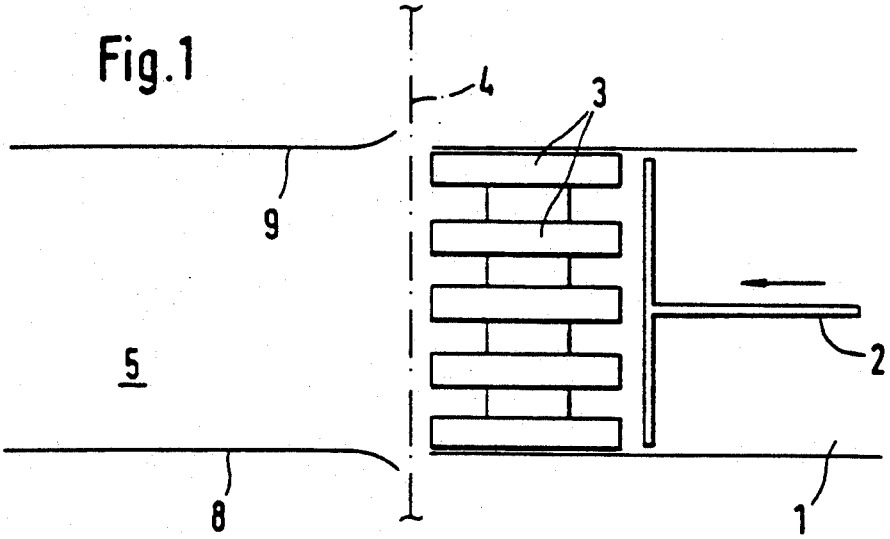
Fig.2
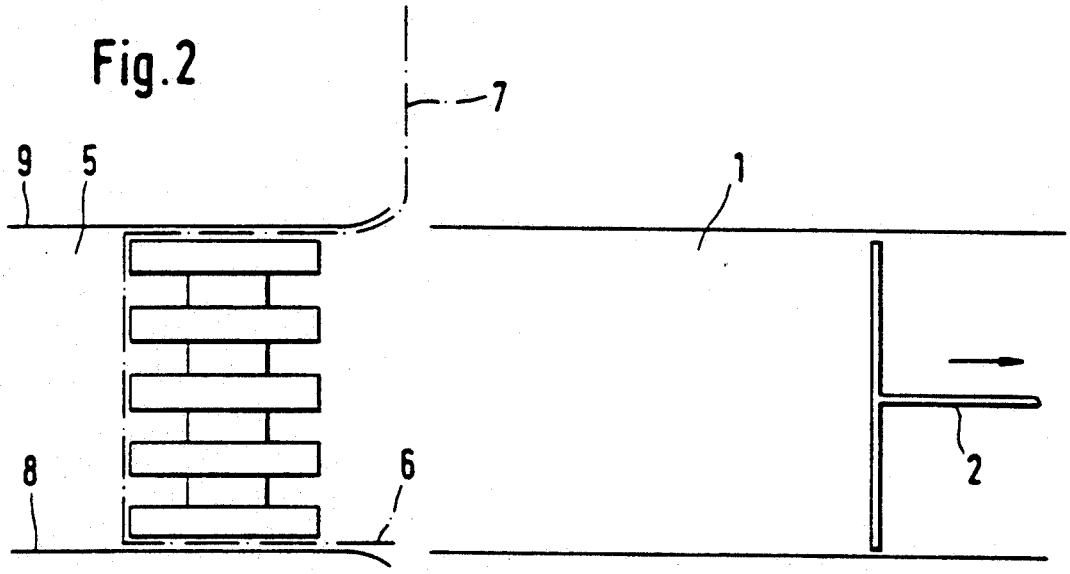
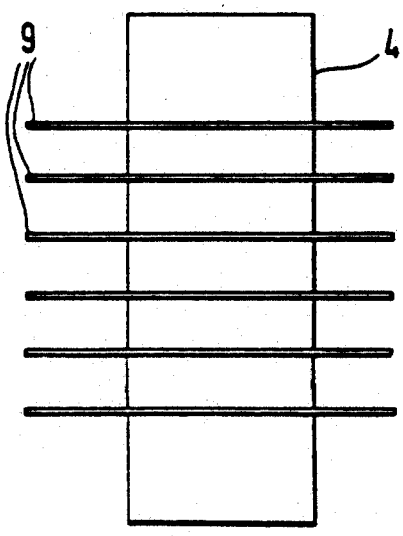
Fig.3

PROCESS OF AND APPARATUS FOR PACKAGING A STACK OF FLAT OBJECTS

BACKGROUND OF THE INVENTION

1. Field of the Invention

This invention relates to a particular process of and a particular apparatus for packaging a stack of flat objects. The stack preferably is composed of bags provided with handles and has a height exceeding the widths of the bags over a section of a web of packaging material consisting of paper and/or plastic film or the like. The stack is preferably compressed and wrapped with a section of the web so that marginal portions of the web section overlap each other on one side face of the stack and are adhesively bonded to each other to form a tubular wrapper. The tubular wrapper surrounds the stack and has end portions which protrude from the stack and are folded from opposite sides against the end faces of the stack so as to form folded corner portions. Each of the folded corner portions is folded onto and adhesively bonded to a wrapped face of the stack.

2. Description of Related Art

U.S. Pat. No. 3,771,280 discloses a process for packaging which can be carried out only by means of a machine comprising three stations. The three stations are disposed one over the other. In the process, the following steps are consecutively carried out: after each stack has been provided outside the machine with the tubular wrapper, the protruding end portions of the tubular wrapper are folded in on mutually opposite sides to overlap each other, so that folded corner portions are formed. The folded corner portions are subsequently folded to overlap each other so as to form a closure which is similar to what is known as a "crossed bottom" closure. Special lifting and lowering means are required for moving the stack from one station to another for the performance of several folding operations. The known process, however, requires the performance of complicated operations, which require expensive structural and mechanical means.

SUMMARY OF THE INVENTION

It is an object of the invention to provide a process which is of the kind described above and which-can be carried out by an apparatus which requires a relatively low expenditure.

In a process of the kind described above, this object is accomplished by first folding one side portion of each protruding end portion of the tubular wrapper onto the adjacent open end face of the stack about the longer edge of the end face. The adjacent ends of each protruding end portion of the wrapper are pulled out and flattened into the plane of the infolded side portion so that the opposite side portion of the protruding end portion is folded about the opposite longer edge of the adjacent end face of the stack onto the end face. Folded corner portions protruding from the stack are thus formed, and the folded corner portions are then folded onto and adhesively bonded to the wrapper on those side faces of the stack which adjoin the initially open side face of the stack. This process, in accordance with the invention, can be carried out by a machine which requires a lower expenditure because the protruding end portions of the wrapper can be folded in on mutually opposite sides by a folding element which is movable across the end face of the stack and is divided so that the parts of the folding element can subsequently be moved laterally outwardly to pull out and flatten portions of the wrapper. In addition to the first folding element, it is sufficient to provide means for folding the folded corner portions which have been formed by the pulling out and flattening of the initially folded inside portions. A special advantage is afforded by the fact that the folded corner portions are formed merely by pulling out and flattening only one infolded side portion so that the folded corner portions are laterally open. The folding elements for pulling out and flattening the initially folded inside portions are moved apart, and can be pulled from the protruding folded corner portions at right angles to the direction of the flattening movement. The simplified process can be performed by a machine in which the wrapping and packaging of the stack can be entirely performed in only one station.

For packaging stacks of flat objects which have such nature that the stack is resiliently compressible, as is the case with stacks of bags provided with handles, the stacks will exert a strong force on the wrapper after the stack has been relieved from a compressing force. That force might cause the end closures which have been formed by the folding of the protruding end portions of the wrapper to burst open. Bags having handles which are thicker than the superposed flat bag walls are usually stacked to form stacks having straight edges. Partial stacks are formed and are subsequently assembled in such an offset relation that superimposed handle portions are disposed between the bottom portions of two partial stacks. Each of the packaged bags provided with handles may be folded on itself about a transverse line. For this reason, the "width" of a bag in the packaged stack may consist of the width of the bag which has been folded before it has been stacked. Even when the stacks are assembled as described to from partial stacks, such stacks, when they are resiliently compressed, exert considerable forces on wrappers formed around the stack which tend to force the wrapper to burst. The wrapper, which has been formed by a process in accordance with the invention, is particularly suitable for the packaging of resiliently compressed stacks, such as stacks of bags provided with handles, because the folded closures at the ends of the wrapper will present a higher resistance to the forces exerted by the resiliently compressed packaged stack as the folded corner portions have been folded out onto the wrapper on those side faces of the stack which adjoin the initially open side face of the stack. Because the folded corner portions are folded in onto the side to be provided with the closure, but rather are folded out, the adhesive joint between the folded corner portions and the wrapper will not be subjected to shearing forces. Rather, the adhesive joint may be stressed, in the worst case, in an upfolding sense so that the folded edge of the wrapper will constitute a substantially deformation-resisting retaining element of the closure.

The length of each protruding end portion of the tubular wrapper suitably exceeds one-half of the width of the initially open side face of the stack but is smaller than the entire width of the side face. With this design, it is ensured that the mutually opposite side portions of the protruding end portions, when they have been folded in, will overlap each other so that a tight closure will be formed.

To ensure that the closure formed by the process in accordance with the invention will be held in position, that side portion of each protruding end portion, which is opposite to the initially infolded side portion and infolded as the initially infolded side portion is pulled out and flattened, is provided on its inside surface with glue, e.g., glue dots, in the area which is designed to overlap the initially infolded side portion.

An apparatus for carrying out the process in accordance with the invention is characterized by the provision of parallel grids and/or plates. The grids and/or plates serve to further compress the compressed stack. The stack is advanced between the grids and/or plates so that it entrains a packaging web section, which constitutes a loop covering the stack on three side faces and is held in front of the receiving end of the grids and/or plates. The invention also includes elements for consecutively folding in the protruding end portions of the web section onto the fourth side face of the stack, and pairs of folding plates, which are adapted to fold in one side portion of each protruding end portion of the wrapper about one edge of the stack and are subsequently movable apart in a lateral direction to pull out the folded corner portions beyond the narrow edges of the stack. The invention further includes flaps or the like for folding the folded corner portions. Depending on the angle defined by the folded corner portions, the folding plates which are adapted to be moved apart suitably have oblique end edges suitably extending at an angle of 45°.

BRIEF DESCRIPTION OF THE DRAWINGS

FIG. 1 is a schematic side elevation view showing consecutive compressing channels, in which compressed stacks to be packaged are advanced, and also a web section of packaging material extending in a gap between two adjacent channels.

FIG. 2 is a view similar to FIG. 1 which shows the stack to be packaged which has been inserted into the succeeding compressing channel and has entrained the web section of packaging material in the form of a loop.

FIG. 3 is a top plan view showing how the stack, surrounded by a tubular wrapper, is held in the second compressing channel.

DETAILED DESCRIPTION OF THE PREFERRED EMBODIMENT

Figure 4:
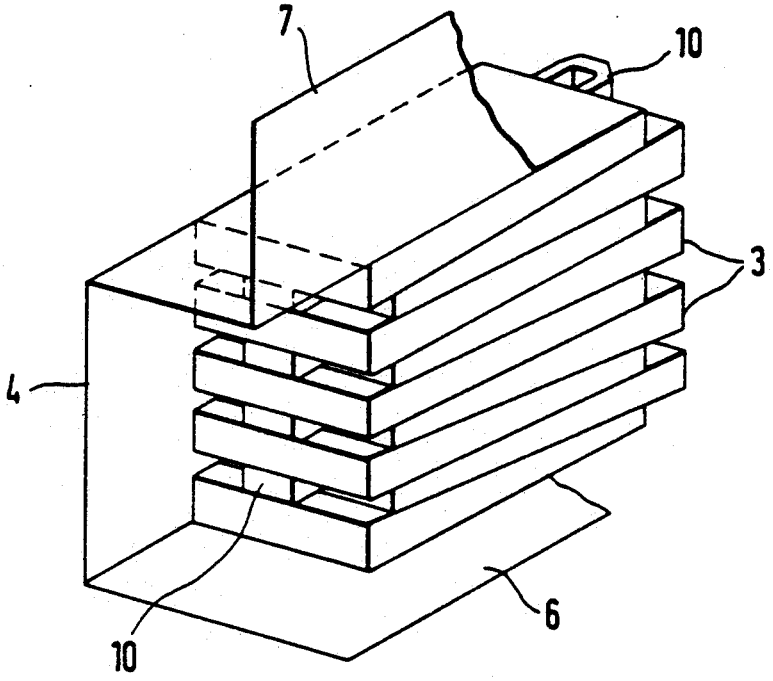
FIG. 4 is a perspective view showing the stack of FIGS. 2 and 3, which is covered on three sides by the web section of packaging material.
Figure 5:
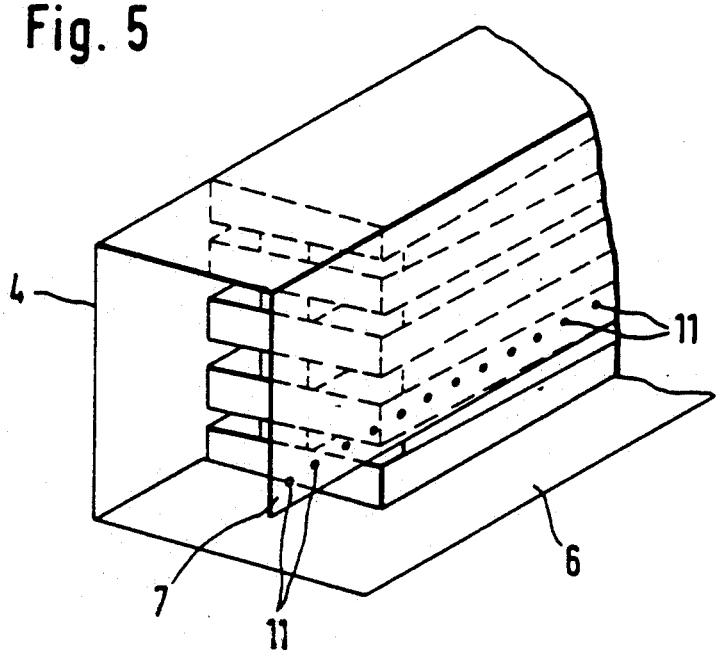
FIG. 5 is a view which is similar to FIG. 4 showing the stack after the to end portion of the web section of packaging material has been laid on the rear side face of the stack.

An illustrative embodiment of the invention will now be described in more detail with reference to the drawings.

In a first compressing channel 1 shown in FIG. 1, a compressed stack 3 of bags is pushed forward by a pusher 2 toward a section 4 of a web of packaging material. The web section 4 of packaging material has a length which is sufficient for wrapping the stack and is suspended, in any desired manner, so as to extend through a gap, which is defined between the first compressing channel 1 and a succeeding second compressing channel 5, which are closely spaced apart.

In the position shown in FIG. 2, the stack 3 of bags has been pushed into the compressing channel 5 and has entrained the curtain like web section 4 of packaging material. The pusher 2 has been retracted over part of its stroke. In FIG. 2, the stack inserted into the second compressing channel is shown as being covered by the web section of packaging material on three side faces. The bottom and top portions 6 and 7, respectively, of the web section of packaging material protrude from the rear side face of the stack. The second compressing channel 5 comprises a stationary bottom plate 8 and a rake-like top grid, which includes, as is most clearly shown in FIG. 3, of discrete parallel bars 9. The rake-like grid has such a width that the web section 4 of packaging material laterally protrudes from the grid 9 at both ends of the stack 3 so that folding elements can engage the protruding end portions of the tubular wrapper, which will subsequently be formed by the web section of packaging material.

Figure 6:
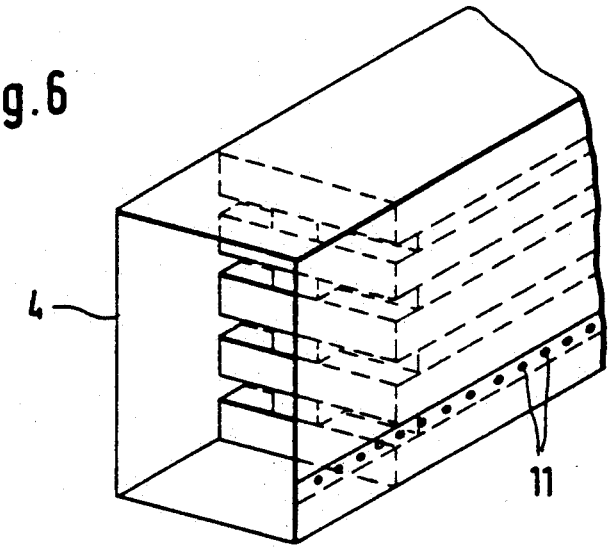
FIG. 6 is a perspective view showing the stack surrounded by a tubular wrapper consisting of the web section of packaging material when the protruding end portions of the wrapper have not yet been folded to form respective closures.

FIG. 4 is a perspective view showing the stack 3 and the web section of packaging material partly covering the stack. The stack 3 and the web section are in the same relative positions as they are in FIG. 2. It is also apparent from FIG. 4 that the bags of the stack 3 constitute partial stacks, which are offset from each other so that the handles 10 of at least one partial stack are disposed between the bottom portions of the bags of adjacent partial stacks. It is also apparent from FIG. 4 that the stack assembled from the partial stacks exerts the strongest resilient forces adjacent to the handles 10 because the material which constitutes each handle is thicker than the material from which each bag is formed. In the position shown in FIG. 4, suitable means, not shown, are used to fold down the top portion 7 of the web section of packaging material and to provide a row of glue dots 11 on the bottom edge portion of the top portion 7. Thereafter, the bottom portion 6 of the web section of packaging material is folded upwardly and forced against the row of glue dots. As a result, the stack is surrounded by a tubular wrapper formed by the web section of packaging material, as is shown in FIG. 6.

Figure 7:
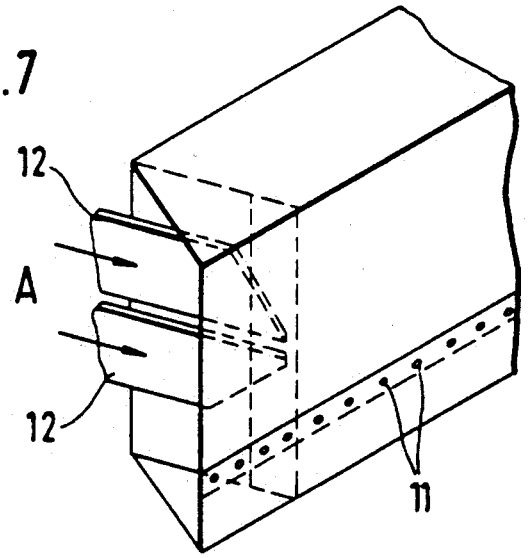
FIG. 7 is a perspective view showing the stack of FIG. 6 after one protruding end portion of the wrapper has been folded in on one side by folding plates moved across the adjacent end face of the stack.
Figure 8:
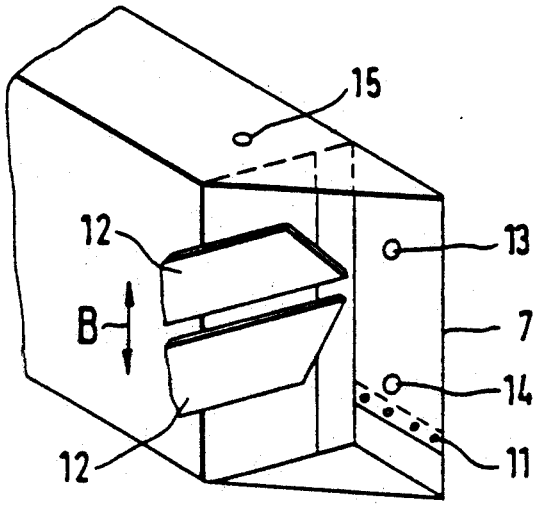
FIG. 8 is a perspective view showing the stack of FIG. 7 viewed in a different direction and showing the pair of folding plates moved across the adjacent end face of the stack.
Figure 9:
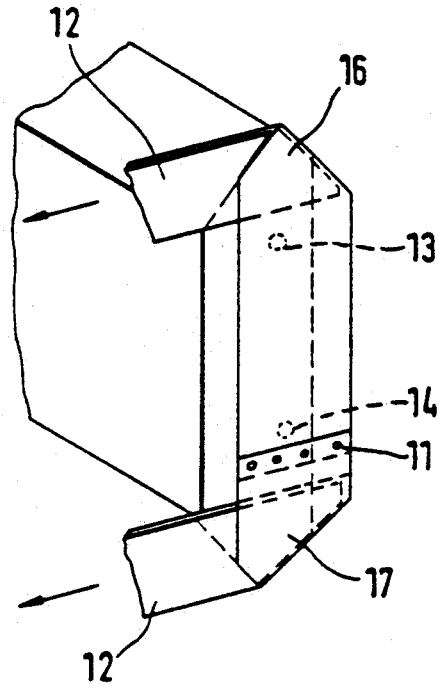
FIG. 9 is a perspective view which is similar to FIGS. 7 and 8 showing the stack after the folding plates have been moved apart to pull out the folded corner portions.

As is illustrated in FIG. 7, a pair of folding plates 12 are then moved against one side portion of one protruding end portion of the tubular wrapper and across the adjacent end face of the stack to impart the shape shown in FIG. 7 to the protruding end portion. Two glue dots 13 and 14 are subsequently applied to the inside surface of the portion 7 of the wrapper. Thereafter, the two folding plates 12 are moved apart in the directions indicated by the arrow B in FIG. 8 to the position which is shown in FIG. 9. This causes the glue dots 13 and 14 to contact the one side portion of the protruding end portion of the tubular wrapper, and forms folded corner portions 16 and 17. At this stage of the packaging operation, additional glue dots 15 are applied to the wrapper on the narrow side faces of the stack. The folded corner portions 16 and 17 of the wrapper are folded down onto the glue dots 15 by suitable means, not shown, after the folding plates of the pair of folding plates 12 have been extracted from the folded corner portions.

Figure 10:
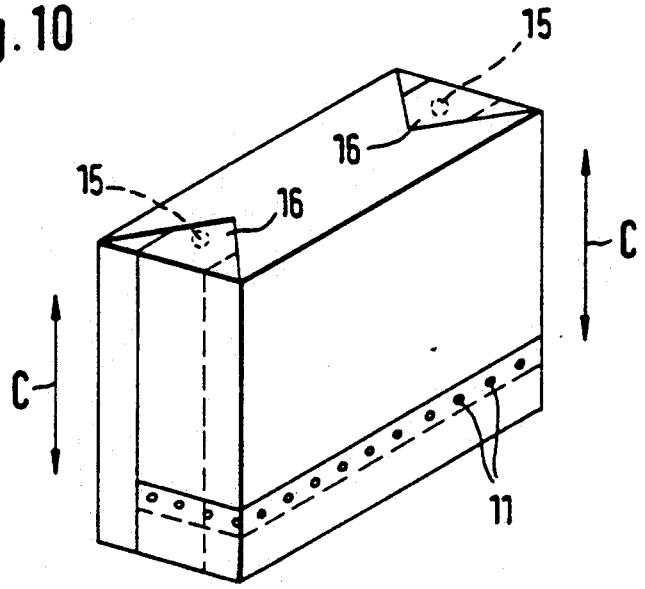
FIG. 10 is a perspective view showing the stack packaged in a web section of packaging material.

Because the folded corner portions 16 and 17 are folded onto and adhesively bonded to the wrapper on narrow side faces of the stack, the resilient forces which are exerted by the stack in the direction indicated by the arrow C in FIG. 10 cannot exert shearing forces on the adhesive joints formed by the glue dots 15. When the stack 3 of bags, which has been wrapped and packaged, as described, is pushed out of the second compressing channel 5, there is no longer a risk that the wrapper which surrounds the stack will burst under resilient forces exerted by the compressed stack of bags.

We claim:

1. An apparatus for packaging a stack of flat bags comprising:

parallel grids and/or plates for compressing the stack of flat bags, means for advancing the stack of flat bags between said parallel grids and/or plates including a loop, covering the stack on three side faces and held in front of a receiving end of the grids and/or plates, entrained by said stack of flat bags as it is advanced, elements for consecutively folding in protruding end portions of the web section onto a fourth side face of the stack, folding plates, provided in at least one pair, which are adapted to fold in one side portion of each protruding end portion of the web section about one edge of the stack, said folding plates being subsequently movable apart to pull out folded corner portions beyond edges of the stack, and means for folding the folded corner portions.

2. A process for packaging a stack of flat bags in a section of a web of packaging material formed of paper and/or plastic film comprising the steps of:

providing a stack of bags, the bags having handles, said stack having a height exceeding widths of the bags.

compressing the stack and wrapping the stack with a section of said web so that marginal portions of the section of said web overlap each other on one side face of the stack, adhesively bonding said marginal portions to each other to form a tubular wrapper which surrounds the stack and forming end portions protruding from the stack, forming folded corner portions from said web at opposite ends of said stack, and folding said folded corner portions onto and adhesively bonding them to a wrapped face of the stack, wherein one side portion of each of the end portions protruding from the stack is first folded onto an adjacent end face of the stack about a longer edge of said end face, adjacent ends of each of the end portions protruding from the stack are pulled out and flattened so that an opposite side portion of the end portions protruding from the stack is folded about an opposite longer edge of the adjacent end face of the stack onto said one side portion and said folded corner portions, protruding from the stack, are thus formed, and the folded corner portions are then folded onto and adhesively bonded to the tubular wrapper, on side faces of the stack, wherein the end portions protruding from the stack are formed to have a length which is greater than one-half of the width of the adjacent end face of the stack and smaller than the entire widths of said side faces.

3. A process for packaging a stack of flat bags in a section of a web of packaging material formed of paper and/or plastic film comprising the steps of:

providing a stack of bags, the bags having handles, said stack having a height exceeding widths of the bags, compressing the stack and wrapping the stack with a section of said web so that marginal portions of the section of said web overlap each other on one side face of the stack, adhesively bonding said marginal portions to each other to form a tubular wrapper which surrounds the stack and forming end portions protruding from the stack, forming folded corner portions from said web at opposite ends of said stack, and folding said folded corner portions onto and adhesively bonding them to a wrapped face of the stack, wherein one side portion of each of the end portions protruding from the stack is first folded onto an adjacent end face of the stack about a longer edge of said end face, adjacent ends of each of the end portions protruding from the stack are pulled out and flattened so that an opposite side portion of the end portions protruding from the stack is folded about an opposite longer edge of the adjacent end face of the stack onto said one side portion and said folded corner portions, protruding from the stack, are thus formed, and the folded corner portions are then folded onto and adhesively bonded to the tubular wrapper, on side faces of the stack, wherein a side portion of each end portion protruding from the stack, which is opposite to the first folded one side portion, is folded in as the adjacent ends are pulled out and flattened and is provided, on its inside surface, with glue deposits in an area which is intended to overlap the first folded one side portion.

* * * * *